US009827664B1

(12) United States Patent
Chen

(10) Patent No.: US 9,827,664 B1
(45) Date of Patent: Nov. 28, 2017

(54) PUSH-BUTTON TOOL BOX WITH SWING SEAT

(71) Applicant: GOOD YEAR HARDWARE CO., LTD., Fu Sing Hsing, Changhua (TW)

(72) Inventor: Tsai-Ching Chen, Changhua (TW)

(73) Assignee: GOOD YEAR HARDWARE CO., LTD., Changhua (TW)

( * ) Notice: Subject to any disclaimer, the term of this patent is extended or adjusted under 35 U.S.C. 154(b) by 0 days.

(21) Appl. No.: 15/240,337

(22) Filed: Aug. 18, 2016

(51) Int. Cl.
*B25H 3/04* (2006.01)
*B25H 3/00* (2006.01)

(52) U.S. Cl.
CPC ..... *B25H 3/04* (2013.01); *B25H 3/003* (2013.01)

(58) Field of Classification Search
CPC . B25H 3/003; B25H 3/02; B25H 3/04; B65D 85/20; B65D 85/24
USPC ..... 206/372–379
See application file for complete search history.

(56) References Cited

U.S. PATENT DOCUMENTS 8,186,510 B1 * 5/2012 Chen ..... B25H 3/003 206/373
8,469,190 B1 * 6/2013 Chang ..... B25H 3/003 206/372
8,899,417 B1 * 12/2014 Chen ..... B25H 3/003 206/372

FOREIGN PATENT DOCUMENTS

DE 102004002038 A1 * 8/2005 ..... B25H 3/003
TW M499994 5/2015

* cited by examiner

*Primary Examiner* — Bryon Gehman
(74) *Attorney, Agent, or Firm* — Muncy, Geissler, Olds & Lowe, P.C.

(57) ABSTRACT

A tool box includes a housing defining a front opening, a rear opening and an accommodation chamber in communication with the front opening and the rear opening to open to the outside; a swing seat pivotally mounted in the housing within the accommodation chamber and providing a storage rack at the bottom side, multiple insertion slots at the top side and a retaining block, a first baffle plate mounted in the housing at a front side relative to the storage rack, a second baffle plate mounted in the housing at a rear side relative to the insertion slots, a push-button, the swing seat to be biased relative to the housing to an access position when the user pushes a push-button.

10 Claims, 8 Drawing Sheets

PUSH-BUTTON TOOL BOX WITH SWING SEAT

BACKGROUND OF THE INVENTION

1. Field of the Invention

The present invention relates to hand tool technology and more particularly, to a tool box, which uses a push-button to control the pivoting of a swing seat relative to a housing.

2. Description of the Related Art

Tool boxes are created for storing hand tools and related tool parts. Taiwan Patent Publication Number M499994 discloses a tool box design for storing screwdriver bits and a screwdriver adapter, comprising: a substantially U-shaped casing defining a mounting port that is open to the outside, and a storage device shaped like a rectangular prism and pivotally mounted in the mounting port of the casing. The storage device comprises a plurality of hexagonal insertion slots arranged on a face wall thereof, a spring leaf mounted in each hexagonal insertion slot for stopping against an inserted screwdriver bit, a magnet located at an opposite face wall thereof, and a pivot rod located at each of two opposite lateral sides thereof. The casing comprises two pivot holes respectively located on two opposite inside walls thereof. The pivot rods of the storage device are respectively pivotally mounted in the respective pivot holes of the casing. Subject to the pivot connection relationship between the casing and the storage device, the user can bias the storage device relative to the casing, making storage screwdriver bits accessible.

From the above we can see that when the user is going to pick up one storage tool part from the tool box, the user must control and bias the storage device relative to the casing to an accessible position. The applicant therefore believes this prior art tool box design is still not convenient in use.

SUMMARY OF THE INVENTION

The present invention has been accomplished under the circumstances in view. It is the main object of the present invention to provide a tool box, when enables a swing seat to be biased relative to the housing to an access position when the user pushes a push-button.

To achieve this and other objects of the present invention, a tool box comprises a housing, a swing seat, a first baffle plate, a second baffle plate, a push-button, a first spring member and a second spring member. The housing comprises a front opening, a rear opening and an accommodation chamber in communication with the front opening and the rear opening to open to the outside. The swing seat is pivotally connected to the housing within the accommodation chamber, comprising a storage rack, a plurality of insertion slots and a retaining block. The storage rack is located at a bottom side of the swing seat. The insertion slots are located at an opposite top side of the swing seat. The first baffle plate is mounted in the housing at a front side relative to the storage rack. The second baffle plate is mounted in the housing at a rear side relative to the insertion slots. The push-button is mounted on the housing, comprising an engagement block. The engagement block is kept in engagement with the retaining block when the push-button is not pushed by the user. On the contrary, the engagement block is forced to disengage from the retaining block when the push-button is pushed by the user. The first spring member is stopped between the housing and the push-button. Further, the first spring member is kept in a released status when the push-button is not pushed by the user. On the contrary, the first spring member is compressed when the user pushes the push-button. The second spring member is stopped between the housing and the swing seat. Further, the second spring member is compressed to store an elastic restoring energy when the push-button is not pushed by the user. On the contrary, the second spring member releases the stored elastic restoring energy to bias the swing seat relative to the housing when the user pushes the push-button.

Thus, applying a force to the push-button can cause the swing seat to bias relative to the housing to an access position, and thus, the invention eliminates the drawback of the prior art design that requires the user to apply a biasing force, providing an advantage of ease of use.

Further, the arrangement of the first baffle plate and the second baffle plate prevents storage tool parts from falling out of the storage rack and the insertion slots during the biasing action of the swing seat, avoiding missing of storage tool parts.

Other advantages and features of the present invention will be fully understood by reference to the following specification in conjunction with the accompanying drawings, in which like reference signs denote like components of structure.

DETAILED DESCRIPTION OF THE INVENTION

Figure 1:
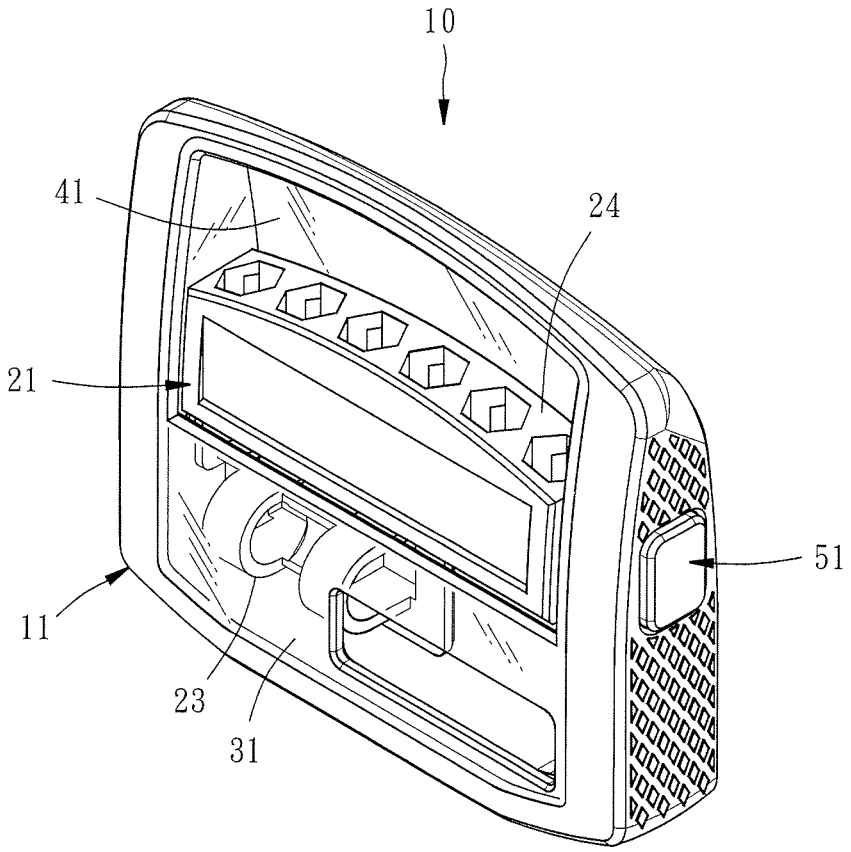
FIG. 1 is an elevational view of a tool box in accordance with the present invention.
Figure 2:
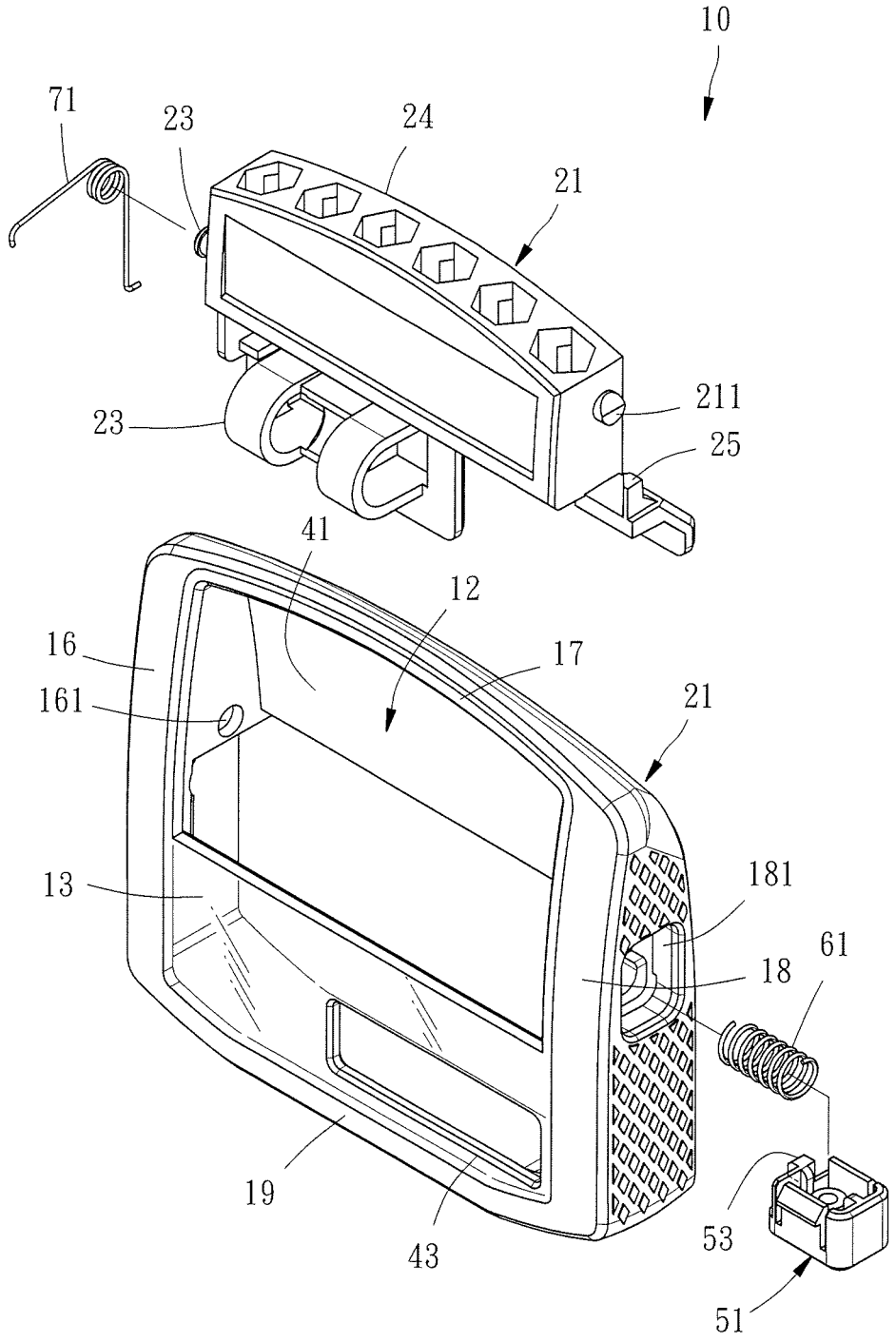
FIG. 2 is an exploded view of the tool box in accordance with the present invention.
Figure 3:
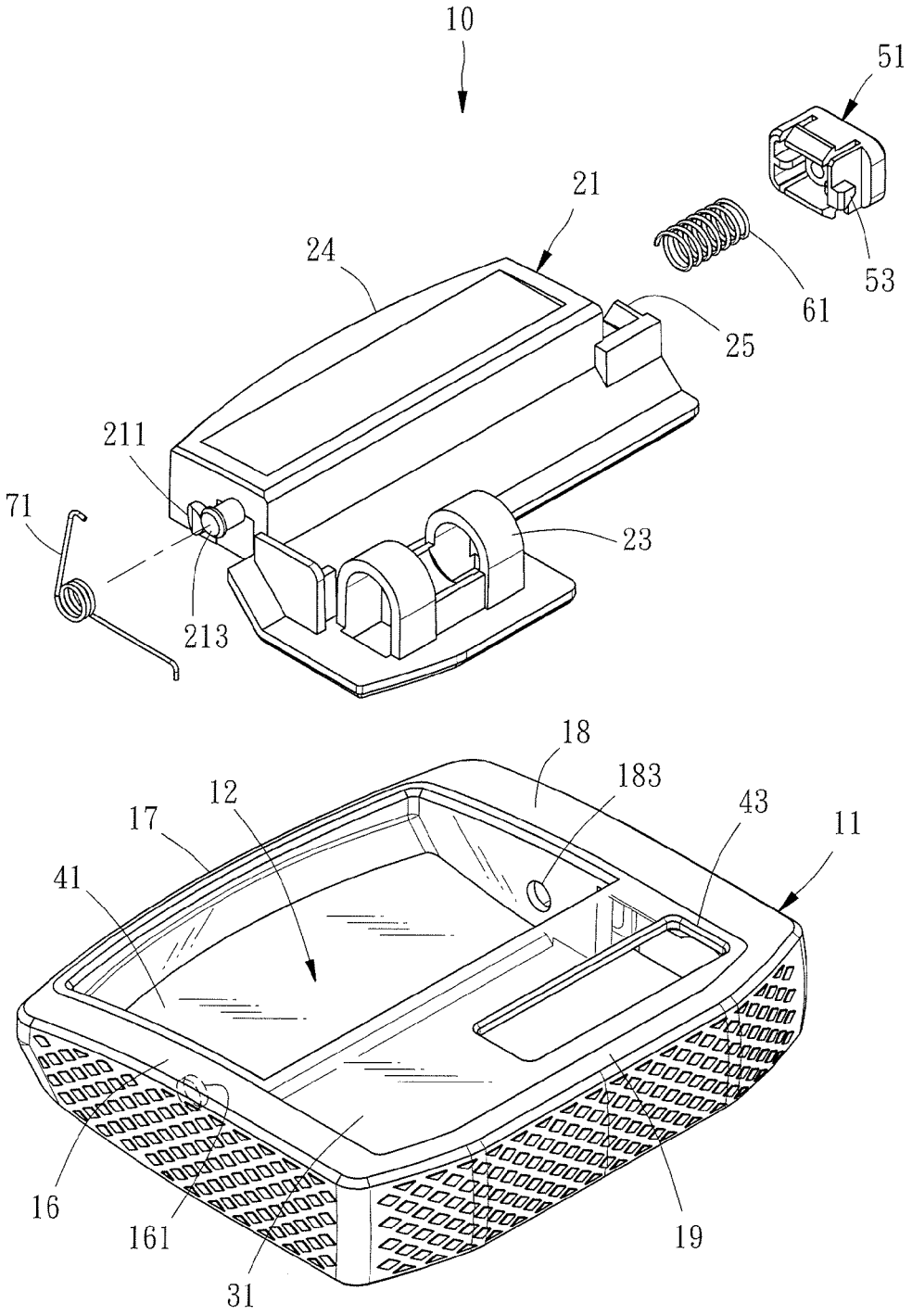
FIG. 3 is another exploded view of the tool box in accordance with the present invention when viewed from another angle.
Figure 4:
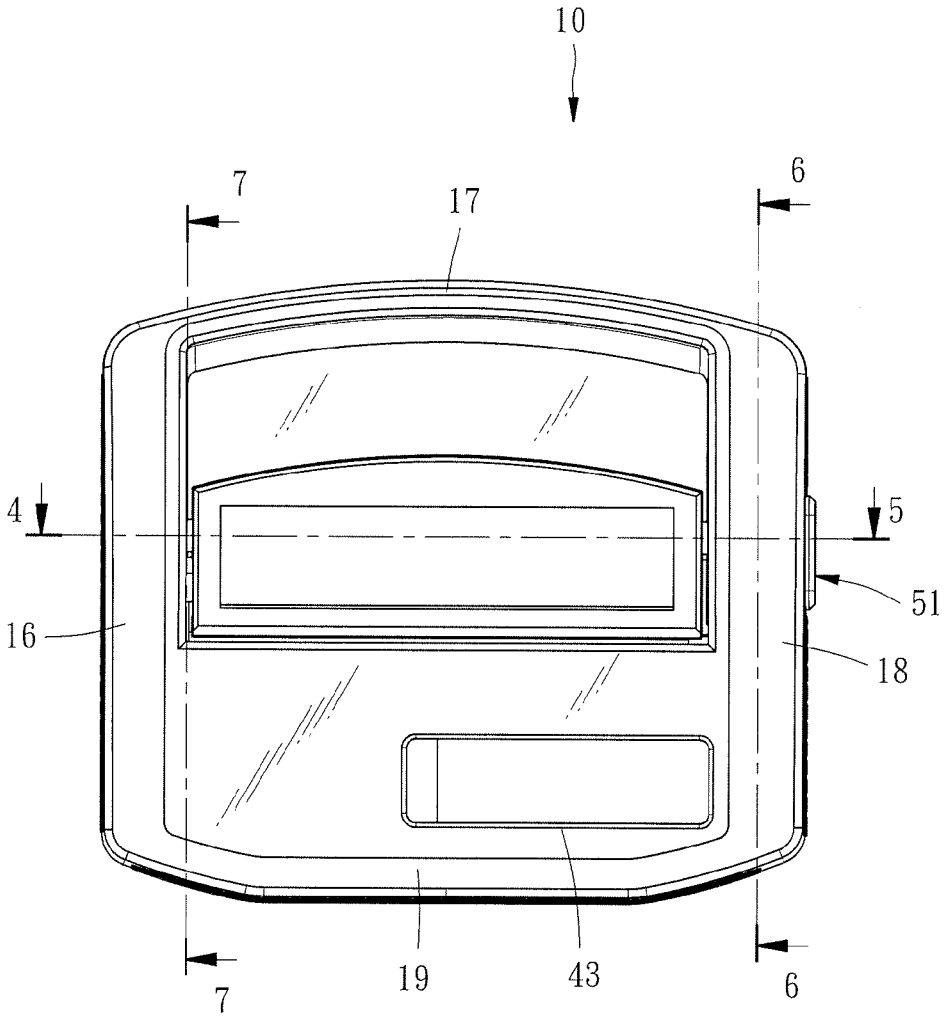
FIG. 4 is a front view of the tool box in accordance with the present invention.
Figure 5:
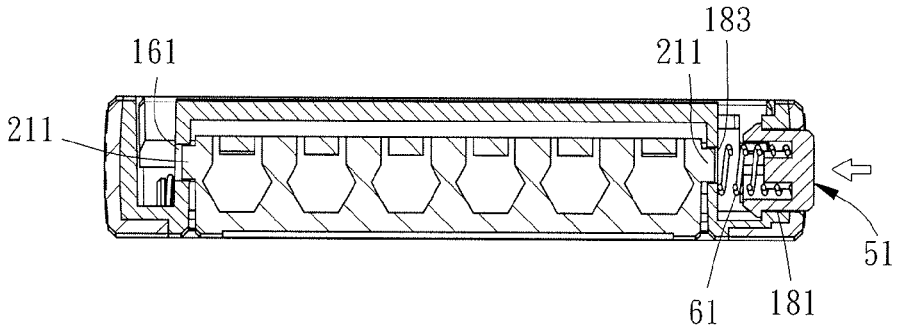
FIG. 5 is a sectional view taken along line 5-5 of FIG. 4.
Figure 6:
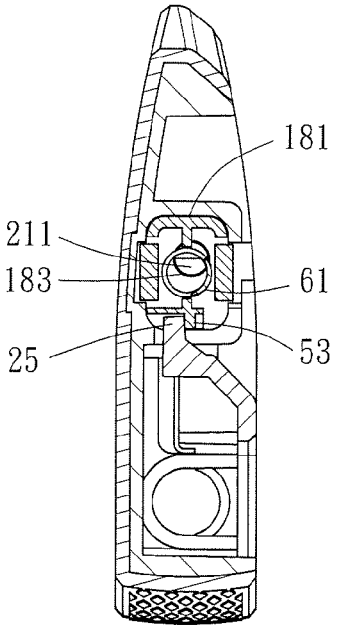
FIG. 6 is a sectional view taken along line 6-6 of FIG. 4.
Figure 7:
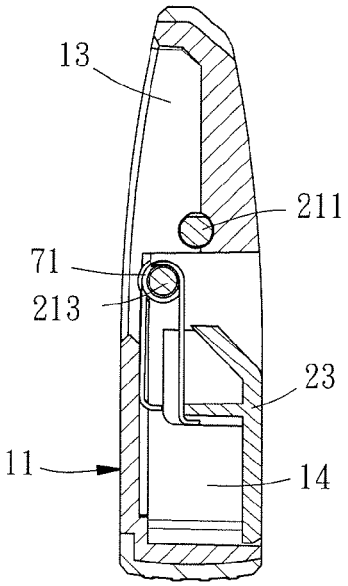
FIG. 7 is a sectional view taken along line 7-7 of FIG. 4.

Referring to FIGS. 1-9, a tool box 10 in accordance with the present invention is shown. The tool box 10 comprises a housing 11, a swing seat 21, a first baffle plate 31, a second baffle plate 41, a push-button 51, a first spring member 61 and a second spring member 71.

The housing 11 defines an accommodation chamber 12, a front opening 13 and a rear opening 14. The accommodation chamber 12 is disposed in communication with the front opening 13 and the rear opening 14, thereby open to the outside. In actual production of the present invention, the housing 11 consists of a first side frame 16, a second side frame 17, a third side frame 18 and a fourth side frame 19. Further, the first side frame 16 and the third side frame 18 are disposed to face toward each other; the second side frame 17 and the fourth side frame 19 are disposed to face toward each other; the first side frame 16 defines therein a recessed hole 161; the third side frame 18 comprises a locating block 181, and a pivot hole 183 located in the locating block 181 to face toward the recessed hole 161 (see FIG. 5).

Figure 8:
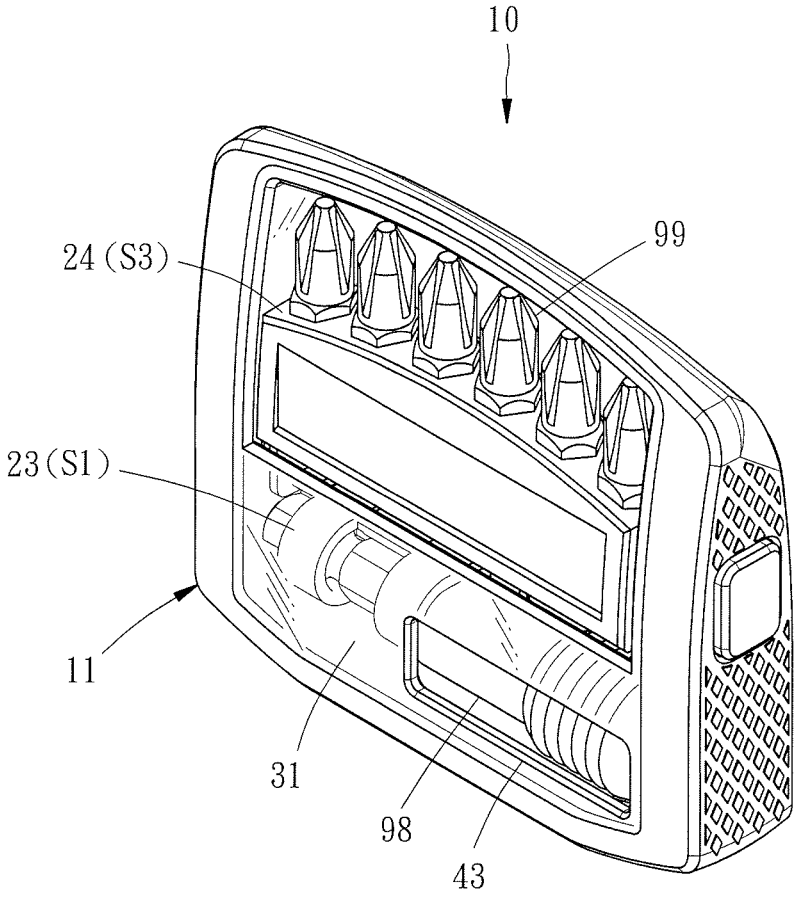
FIG. 8 is a schematic drawing illustrating one application example of the present invention.
Figure 9:
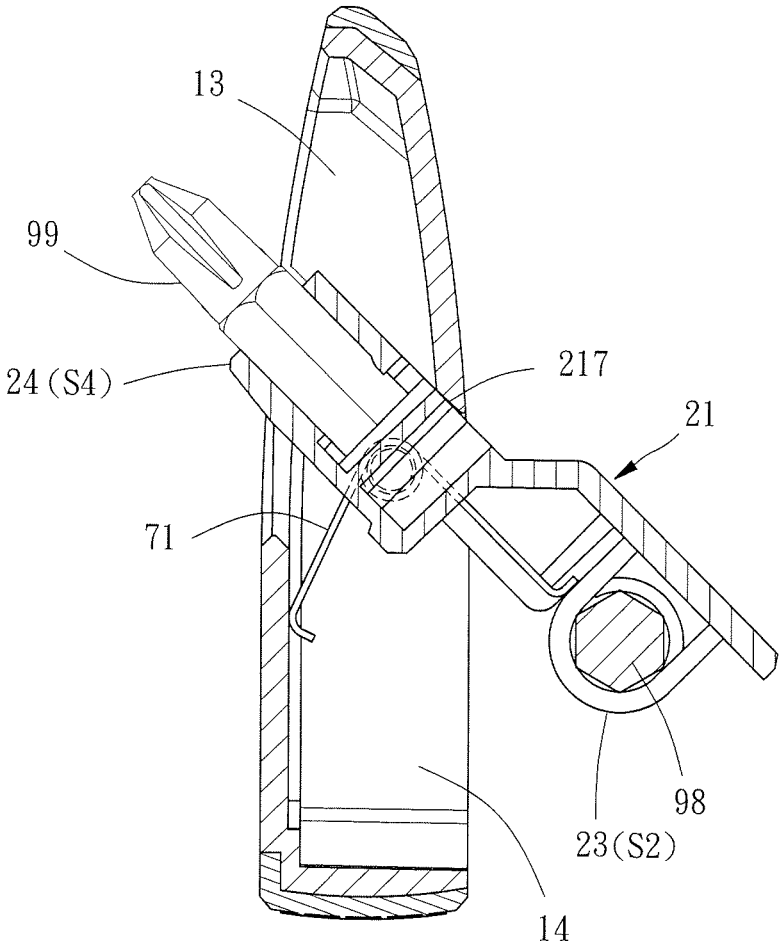
FIG. 9 is a schematic drawing illustrating another application example of the present invention.
Figure 10:
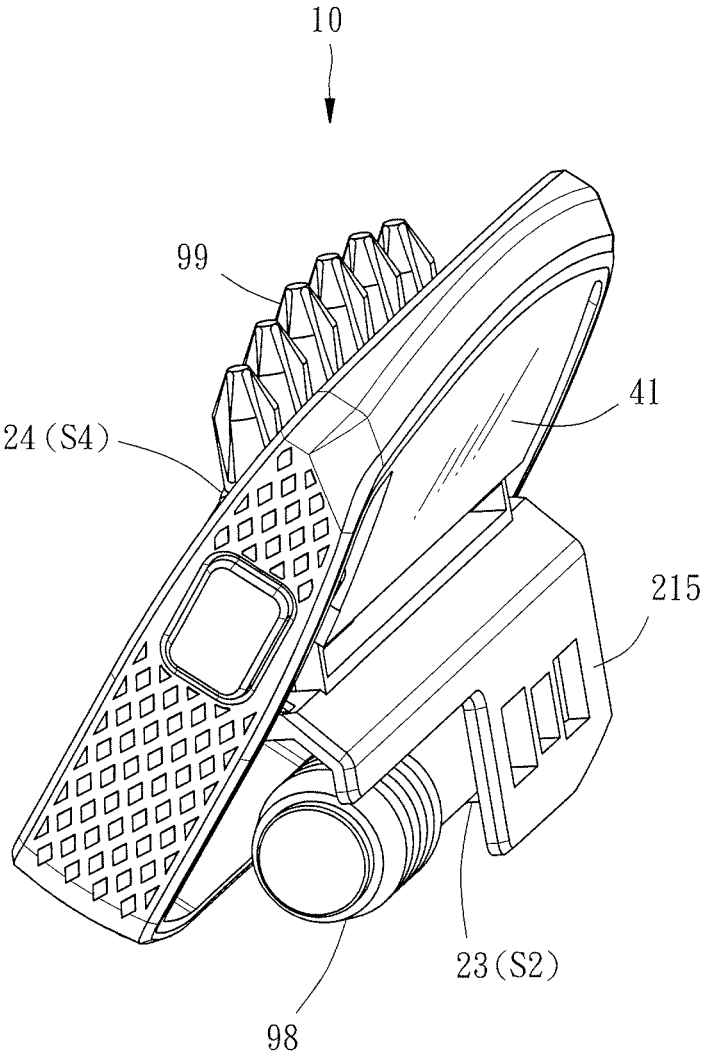
FIG. 10 is a schematic drawing illustrating still another application example of the present invention.

The swing seat 21 is pivotally mounted in the housing 11 within the accommodation chamber 12, comprising a storage rack 23, a plurality of insertion slots 24 and a retaining block 25. As illustrated in FIGS. 8-10, the storage rack 23 is located at a bottom side of the swing seat 21 for holding a screwdriver adapter 98; the insertion slots 24 are located at an opposing top side of the swing seat 21 for holding multiple screwdriver bits 99. However, the location of the storage rack 23 and the location of the insertion slots 24 can be exchanged according to different application requirements. The tool storage direction of the storage rack 23 and the insertion slots 24 can also be changed without departing from the spirit of the present invention. Further, in actual production, the pivot connection between the swing seat 21 and the housing 11 can be achieved as described hereinafter. The swing seat 21 is configured to provide two pivot rods 211 that are respectively located at two opposite lateral sides of the swing seat 21 and respectively pivotally connected to the recessed hole 161 and the pivot hole 183 (see FIG. 5); the swing seat 21 further comprises a locating pin 213 located at one lateral side; the first spring member 71 is mounted around the locating pin 213 with two opposite ends thereof respectively stopped against the housing 11 and the storage rack 23 (see FIG. 7). In an alternate form of the present invention, the first spring member 71 is directly mounted around one pivot rod 211. In actual production, the swing seat 21 further comprises a stopper plate 215 disposed at a rear side relative to the storage rack 23, and an abutment portion 217 for abutment against the second baffle plate 41 (see FIG. 9) to stop the swing seat 21 in position after the swing seat 21 having been biased.

The first baffle plate 31 is mounted in the housing 11 at a front side relative to the storage rack 23. Further, the first baffle plate 31 is made from a transparent material (for example, transparent plastic or glass). Further, the first baffle plate 31 comprises an elongated opening 43 for receiving a part of the screwdriver adapter 98 so that the overall thickness of the tool box 10 can be minimized.

The second baffle plate 41 is mounted in the housing 11 at a rear side relative to the insertion slots 24. Further, in actual production, the second baffle plate 41 is made from a transparent material (for example, transparent plastic or glass).

The arrangement of the first baffle plate 31 and the second baffle plate 41 is adapted to prohibit storage tool parts from falling out of the storage rack 23 and the insertion slots 24 when the swing seat 21 is being biased. Further, because the first baffle plate 31 and the second baffle plate 41 are transparent, the user can visually check the storage condition of storage tool parts without opening the tool box 10.

The push-button 51 is mounted in the housing 11, comprising an engagement block 53. In application, when the push-button 51 is not moved, the engagement block 53 is kept in engagement with the retaining block 25; on the contrary, when the push-button 51 is moved, the engagement block 53 is disengaged from the retaining block 25. In the present preferred embodiment, the push-button 51 is operated by pressing. However, in actual application, sliding or rotary control design, or any other switching control design can be used to substitute for the pressing control design of the push-button 51.

The first spring member 61 in the present preferred embodiment is a compression spring stopped between the housing 11 and the push-button 51. When the push-button 51 is not operated, the first spring member 61 is disposed kept in a released status subject to the effect of an elastic restoring energy; on the contrary, when the push-button 51 is moved, the first spring member 61 is compressed.

The second spring member 71 in the present preferred embodiment is a torsion spring stopped between the housing 11 and the swing seat 21. In the present preferred embodiment, the second spring member 71 has one end thereof stopped against the housing 11, and the opposite end thereof stopped against the storage rack 23. Thus, the second spring member 71 enhances the pivoting action of the swing seat 21 relative to the housing 11. When the push-button 51 is not moved, the second spring member 71 is compressed to generate an elastic restoring energy; on the contrary, when the push-button 51 is moved, the elastic restoring energy of the second spring member 71 forces the swing seat 21 to bias relative to the housing 11.

After explanation of the structural details of the tool box 10, the operation of the tool box 10 is outlined hereinafter.

When the user is going to pick up or store a tool part, apply a force to the push-button 51 to move the push-button 51 toward the inside of the housing 11, forcing the engagement block 53 of the push-button 51 to release from the retaining block 25 of the swing seat 21. At this time, the first spring member 71 pushes the storage rack 23 from a first storage position S1 toward the rear opening 14. When the abutment portion 271 is abutted against the second baffle plate 41, the swing seat 21 is stopped in place, holding the storage rack 23 in a first access position S2, and at the same time, the insertion slots 24 are shifted from a second storage position S3 to a second access position S4. After picked up or stored the tool part, push the storage rack 23 or the insertion slots 24 toward the inside of the housing 11 to force the retaining block 25 of the swing seat 21 into engagement with the engagement block 53 again, returning the storage rack 23 and the insertion slots 24 back to their previous positions and achieving the storage effects.

Thus from the above, we can see that applying a force to the push-button 51 can cause the swing seat 21 to bias relative to the housing 11 to an access position, providing an advantage of ease of use.

Further, the arrangement of the first baffle plate 31 and the second baffle plate 41 prevents storage tool parts from falling out of the storage rack 23 and the insertion slots 24 during the biasing action of the swing seat 21, avoiding missing of storage tool parts.

Further, the first baffle plate 31 and the second baffle plate 41 are transparent, and thus, the user can visually check the storage condition of storage tool parts without opening the tool box 10, providing an advantage of ease of use.

Finally, it's worth mentioning that the first baffle plate 31 provides an elongated opening 43 for receiving a part of the screwdriver adapter 98 so that the overall thickness of the tool box 10 can be minimized.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A tool box, comprising:

a housing comprising an accommodation chamber, a front opening and a rear opening, said accommodation chamber being disposed in communication with said front opening and said rear opening to open to the outside;

a swing seat pivotally connected to said housing within said accommodation chamber, said swing seat comprising a storage rack, a plurality of insertion slots and a retaining block, said storage rack being located at a bottom side of said swing seat, said insertion slots being located at an opposite top side of said swing seat;

a first baffle plate mounted in said housing at a front side relative to said storage rack;

a second baffle plate mounted in said housing at a rear side relative to said insertion slots;

a push-button mounted on said housing, said push-button comprising an engagement block, said engagement block being kept in engagement with said retaining block when said push-button receives no external force, said engagement block being forced to disengage from said retaining block when said push-button is pushed by an external force;

a first spring member stopped between said housing and said push-button, said first spring member being in a released status when said push-button receives no external force, said first spring member being compressed when said push-button is pushed by an external force; and a second spring member stopped between said housing and said swing seat, said second spring member being compressed to store an elastic restoring energy when said push-button receives no external force, said second spring member releases the stored elastic restoring energy to bias said swing seat relative to said housing when said push-button is pushed by an external force.

2. The tool box as claimed in claim 1, wherein said housing consists of a first side frame, a second side frame, a third side frame and a fourth side frame, said first side frame and said third side frame being disposed to face toward each other, said second side frame and said fourth side frame being disposed to face toward each other, said first side frame comprising a recessed hole, said third side frame comprising a locating block, said locating block defining therein a pivot hole, said pivot hole being disposed to face toward said recessed hole.

3. The tool box as claimed in claim 2, wherein said swing seat comprises two pivot rods respectively located at two opposite lateral sides thereof and respectively pivotally coupled to said recessed hole and said pivot hole.

4. The tool box as claimed in claim 1, wherein said swing seat further comprises a locating pin; said second spring member is mounted around said locating pin, having one end thereof stopped against said housing and an opposite end thereof stopped again said storage rack.

5. The tool box as claimed in claim 1, wherein said swing seat further comprises a stopper plate disposed at a rear side relative to said storage rack.

6. The tool box as claimed in claim 1, wherein said swing seat further comprises an abutment portion for abutment against said second baffle plate.

7. The tool box as claimed in claim 1, wherein said first spring member is a compression spring; said second spring member is a torsion spring.

8. The tool box as claimed in claim 1, wherein said second spring member has one end thereof stopped against said housing, and an opposite end thereof stopped against said storage rack.

9. The tool box as claimed in claim 1, wherein said first baffle plate and said second baffle plate are transparent.

10. The tool box as claimed in claim 1, wherein said first baffle plate defines therein an elongated opening.

* * * * *